US007559271B2

(12) United States Patent
Komiyama et al.

(10) Patent No.: US 7,559,271 B2
(45) Date of Patent: Jul. 14, 2009

(54) WORKING MACHINE

(75) Inventors: Masayuki Komiyama, Hiroshima (JP); Toshio Sora, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 259 days.

(21) Appl. No.: 11/548,089

(22) Filed: Oct. 10, 2006

(65) Prior Publication Data

US 2007/0125226 A1 Jun. 7, 2007

(30) Foreign Application Priority Data

Nov. 22, 2005 (JP) ..... 2005-336917

(51) Int. Cl.
*F15B 13/02* (2006.01)

(52) U.S. Cl. ..... 91/529; 91/459; 91/461

(58) Field of Classification Search ..... 60/427; 91/361, 433, 459, 461, 529
See application file for complete search history.

(56) References Cited

U.S. PATENT DOCUMENTS

| | | | | |
|---|---|---|---|---|
| 4,986,165 | A * | 1/1991 | Miyaoka | 91/529 |
| 5,125,232 | A * | 6/1992 | Arii et al. | 91/530 |
| 5,235,811 | A * | 8/1993 | Arii et al. | 91/529 |
| 5,640,892 | A * | 6/1997 | Kauss et al. | 91/447 |
| 5,784,944 | A * | 7/1998 | Tozawa et al. | 91/361 |
| 6,435,289 | B1 * | 8/2002 | Hori et al. | 180/6.3 |
| 6,601,670 | B2 * | 8/2003 | Kaneda et al. | 180/333 |
| 6,666,023 | B2 * | 12/2003 | Nagura et al. | 60/427 |
| 6,684,905 | B2 * | 2/2004 | Yamaguchi | 91/529 |
| 6,851,207 | B2 | 2/2005 | Yoshimatsu | |

FOREIGN PATENT DOCUMENTS

| | | |
|---|---|---|
| JP | 5-96443 | 12/1993 |
| JP | 7-48761 | 11/1995 |
| JP | 08-500418 | 1/1996 |
| JP | 09-235756 | 9/1997 |
| JP | 2914730 | 4/1999 |
| JP | 2001-011897 | 1/2001 |
| JP | 2002-266808 | 9/2002 |
| JP | 2005-282796 | 10/2005 |
| JP | 2005-290674 | 10/2005 |

* cited by examiner

*Primary Examiner*—Michael Leslie
(74) *Attorney, Agent, or Firm*—Oblon, Spivak, McClelland, Maier & Neustadt, P.C.

(57) ABSTRACT

Of a plurality of hydraulic signals output from an operating device, a hydraulic signal is input into a control valve serving as a hydraulic control device without conversion, and particular hydraulic signals are converted into electric signals corresponding to their hydraulic pressures by signal converting devices, such as pressure sensors, and are then input into a controller. The controller controls the drive of an electric actuator, such as a rotating electric motor, on the basis of the electric signals. Hydraulic fluid flow paths communicating to the pressure sensors are connected to each other via a throttle, and air in one of the hydraulic fluid flow paths is removed using the other hydraulic fluid flow path.

4 Claims, 3 Drawing Sheets

WORKING MACHINE

BACKGROUND OF THE INVENTION

1. Field of the Invention

The present invention relates to a working machine having an apparatus that controls the operation of a plurality of actuators according to the operation of an operating member by an operator.

2. Description of the Related Art

The following techniques are known as apparatuses that control the operation of a plurality of actuators according to the operation of an operating lever by an operator.

Japanese Examined Utility Model Registration Application Publication No. 7-48761 discloses an apparatus including a plurality of hydraulic remote control valves that output a hydraulic pressure according to the operation amount of an operating lever, and pilot switching valves connected to actuators. The hydraulic pressure output from the remote control valves is input as a pilot pressure into a pilot chamber of one of the switching valves. According to circumstances, the user can switch between a plurality of combinations of the hydraulic remote control valves and the pilot switching valves by the switching operation of an operation-system switching valve interposed between the hydraulic remote control valves and the pilot switching valves.

Japanese Unexamined Patent Application Publication No. 2002-105985 discloses an apparatus that converts the operation amount of an operating lever into an electric signal, inputs the electric signal into a controller, converts the electric signal output from the controller into a hydraulic signal with an electromagnetic proportional reducing valve or the like, and inputs the hydraulic signal into one of hydraulic control valves, thereby controlling the operation of a hydraulic actuator connected to the control valve.

The apparatus of Japanese Examined Utility Model Registration Application Publication No. 7-48761 inputs the hydraulic pressure output from the hydraulic remote control valves into a pilot chamber of one of the pilot switching valves. Therefore, the apparatus can only be used for the drive control of hydraulic actuators. Therefore, in the case of a working machine having electric actuators in addition to hydraulic actuators (for example, a hybrid working machine), it is necessary to provide an additional control system for operating the electric actuators.

In the apparatus of Japanese Unexamined Patent Application Publication No. 2002-105985, of the electric signals output from the controller, electric signals used for controlling the hydraulic control valves are converted into hydraulic signals with an electromagnetic proportional reducing valve or the like. On the other hand, as for the control of electric actuators, electric signals can be used without conversion. Therefore, both hydraulic actuators and electric actuators can be operated with a common control system. However, to construct this apparatus, it is necessary to use many expensive electric components, for example, a linear encoder (or a differential transformer) for converting the operation amount of the operating lever into an electric signal, an amplifier, and solenoids in the electromagnetic proportional reducing valve. Therefore, it is inevitable that the entire apparatus is expensive compared to hydraulic control systems.

Japanese Patent No. 2914730 discloses an operating apparatus having a function as a hydraulic remote control valve that converts the operation amount of an operating lever into a hydraulic signal and controls a pilot switching valve, and a function to convert the operation amount into an electric signal in order to input the electric signal into another controlled object that is simultaneously controlled in association with the switching valve controlled by the remote control valve. However, such an operating apparatus is expensive compared to normal hydraulic remote control valves and can only be used for simultaneous associated control.

SUMMARY OF THE INVENTION

It is an object of the present invention to provide a working machine having a control apparatus that has an inexpensive configuration including an operating device outputting hydraulic signals, for example, a hydraulic remote control valve and that can control both hydraulic actuators and electric actuators.

The inventors have conceived of constructing an apparatus such that one of hydraulic signals output according to operation of an operating device is input into a hydraulic control device, the other hydraulic signals are converted into electric signals by a signal converting device, the electric signals are input into an electric control device, and thereby both hydraulic actuators and electric actuators are controlled by a common control system.

However, if hydraulic oil is simply supplied to the signal converting device through piping in order to input hydraulic signals into the signal converting device, air and the like in the hydraulic oil stay before the signal converting device and can hinder normal hydraulic pressure transmission to the signal converting device.

The present invention is made from the above viewpoint, and the working machine according to the present invention has the following basic configuration.

That is to say, the working machine of the present invention includes actuators including a hydraulic actuator and an electric actuator, and a control apparatus that controls operation of the actuators. The control apparatus includes an operating device, a hydraulic control device, a plurality of signal converting devices, and an electric control device. The operating device outputs hydraulic signals according to operation of an operating member. The hydraulic control device receives one of the hydraulic signals output from the operating device and controls operation of the hydraulic actuator. The plurality of signal converting devices convert the other hydraulic signals output from the operating device into electric signals corresponding to their respective hydraulic pressures. The electric control device receives the electric signals from the signal converting devices and controls operation of the electric actuator. The signal converting devices include a first signal converting device and a second signal converting device. The operating device includes a first signal output valve and a second signal output valve that are respectively connected to the first signal converting device and the second signal converting device via hydraulic fluid flow paths and that are alternatively selected by operation of the operating member. One of the first signal output valve and the second signal output valve selected by operation of the operating member sends out hydraulic fluid at a fluid pressure corresponding to the operation amount of the operating member to the signal converting device to which the signal output valve is connected. The other signal output valve communicates the hydraulic fluid flow path connected to the signal output valve to a tank. The hydraulic fluid flow paths are connected to each other via a throttle.

This apparatus inputs one of the hydraulic signals output from the operating device into the hydraulic control device without conversion, converts particular hydraulic signals into electric signals, and inputs the electric signals into the electric control device. Therefore, although the operating device is inexpensive and outputs only hydraulic signals, this apparatus can control both hydraulic actuators and electric actuators using the hydraulic signals.

The first signal output valve and the second signal output valve are alternatively selected by operation of the operating member. When one of the first signal output valve and the second signal output valve is selected by operation of the operating member, the signal output valve supplies hydraulic oil at a hydraulic pressure corresponding to the operation amount of the operating member, to the signal converting device connected to the signal output valve, through the hydraulic oil flow path. On the other hand, the other signal output valve, that is to say, the signal output valve that is not selected by operation of the operating member communicates the hydraulic oil flow path connecting the signal output valve and the signal converting device corresponding to the signal output valve to a tank, thereby performing cancellation of the hydraulic signal. In addition, since the hydraulic oil flow paths are connected to each other via the throttle, air and the like in the hydraulic oil supplied to one of the signal output valves is allowed to escape to the tank side through the throttle, the hydraulic oil flow path connected to the other signal output valve, and the other signal output valve. Therefore, by effectively utilizing the tank-communicating operation performed by one of the signal output valves for canceling the hydraulic signal, air and the like can be effectively prevented from staying before the first signal converting device or the second signal converting device and hindering the signal conversion. Consequently, an excellent signal converting function can be ensured by effectively utilizing the tank-communicating function of the signal output valve that is not selected.

The size of the throttle can be set so as to be able to transmit air and the like without affecting the transmission of the hydraulic signals to the pressure converting devices through the hydraulic oil flow paths.

The operating device preferably includes a plurality of signal output valves that include the first signal output valve and the second signal output valve and that correspond to the hydraulic signals. In addition, the control apparatus preferably has the following configuration. The control apparatus further includes a signal transmission switching valve provided between the signal output valves of the operating device and the hydraulic control device and the electric control device. The signal transmission switching valve includes a plurality of input portions that are connected to the signal output valves of the operating device and into which hydraulic fluid flows and a plurality of output portions from which the hydraulic fluid flows out. One of the output portions is connected to the hydraulic control device. The other output portions are connected to the signal converting devices including the first signal converting device and the second signal converting device. The signal transmission switching valve is adapted to switch between a plurality of combinations of the input portions and the output portions communicated to the input portions. Hydraulic fluid flow paths respectively connecting the signal transmission switching valve to the first signal converting device and the second signal converting device are connected to each other via the throttle.

Due to this configuration, even when the working machine has both hydraulic actuators and electric actuators, the control apparatus can be switched between a plurality of combinations of hydraulic signals output from the operating device and the actuators by operation of the signal transmission switching valve.

Also in this case, since the hydraulic fluid flow paths respectively connecting the signal transmission switching valve to the first signal converting device and the second signal converting device are connected to each other via the throttle, air and the like can be effectively prevented from staying before the signal converting devices. In this configuration, by operation of the signal transmission switching valve, it is possible to select a first signal output valve (that is to say, a signal output valve connected to the first signal converting device) and a second signal output valve (that is to say, a signal output valve connected to the second signal converting device) from the signal output valves included in the operating device.

The first signal converting device and the second signal converting device are preferably housed in a common electromagnetic shield container. In this case, in spite of its simple structure, the control apparatus can effectively prevent the signal conversion function of the signal converting devices from being hindered by external noise.

The common electromagnetic shield container preferably further houses the electric control device to which the first signal converting device and the second signal converting device are connected and electric lines for the connection.

In this case, the electric lines can be effectively prevented from being affected by noise. Therefore, the accuracy of electric control can be further improved.

In the present invention, although the working machine may employ any electric actuators, if the electric actuators include a rotating electric motor that rotates a rotating body of the working machine, a large amount of electric energy can be recaptured when the rotation is braked.

DESCRIPTION OF THE PREFERRED EMBODIMENTS

Figure 3:
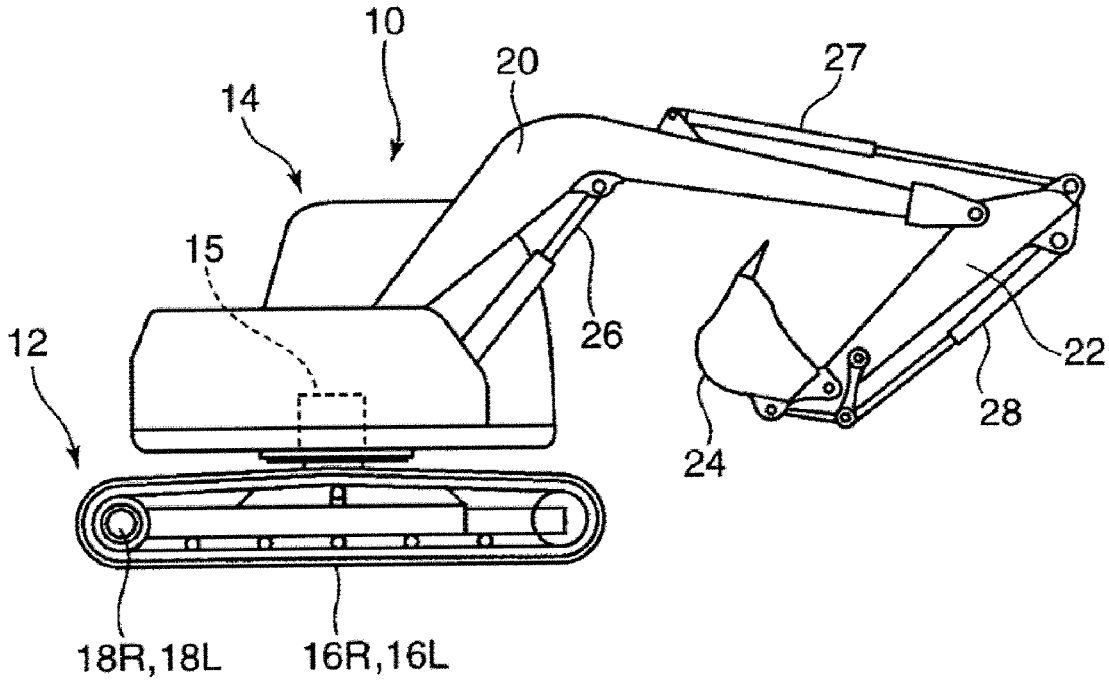
FIG. 3 is an external view of the hydraulic shovel.

The preferred embodiment of the present invention will now be described with reference to the drawings. In this embodiment, the present invention is applied to a hydraulic shovel 10 shown in FIG. 3. However, the present invention can also be applied to other working machines, for example, hydraulic cranes, and demolition machines.

The hydraulic shovel 10 includes a lower traveling body 12 and an upper rotating body 14 rotatably mounted thereon.

The lower traveling body 12 includes left and right traveling crawlers 16L and 16R. The traveling crawlers 16L and 16R respectively include traveling motors 18L and 18R, which are hydraulic motors for rotating sprockets of the traveling crawlers 16L and 16R.

The upper rotating body 14 has a rotating electric motor 15 mounted thereon for rotating the upper rotating body 14. In addition, the upper rotating body 14 is provided with a raisable and lowerable boom 20, which serves as a working attachment of the hydraulic shovel 10. The boom 20 has an arm 22 rotatably joined to the tip thereof. The arm 22 has a bucket 24 rotatably attached to the tip thereof. The raising and lowering of the boom 20, the rotation of the arm 22 relative to the boom 20, and the rotation of the bucket 24 relative to the arm 22 are performed by expansion and contraction of a pair of (left and right) boom cylinders 26, a pair of (left and right) arm cylinders 27, and a pair of (left and right) bucket cylinders 28, respectively.

Figure 1:
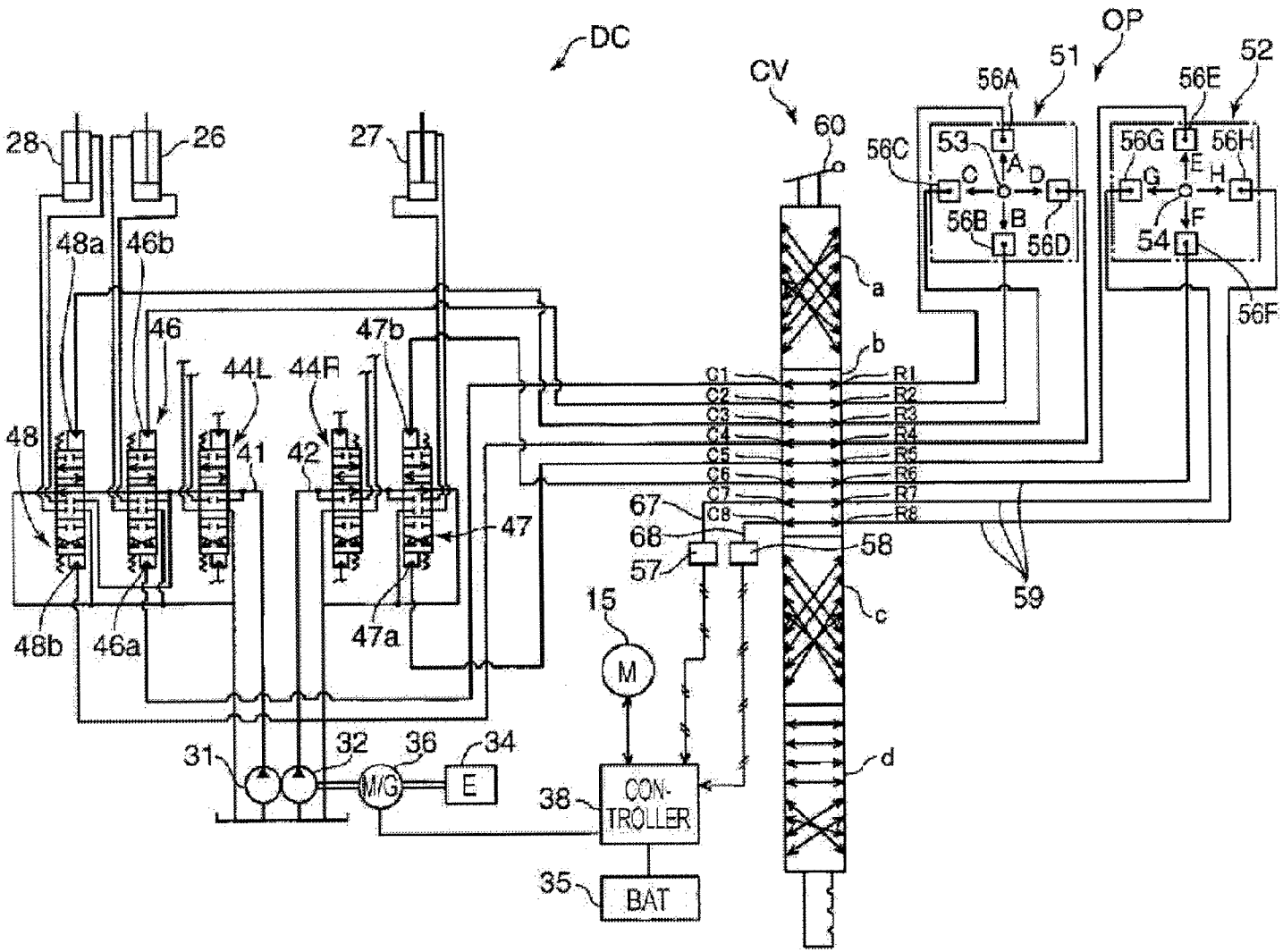
FIG. 1 is a circuit diagram showing a control apparatus for a hydraulic shovel according to an embodiment of the present invention.

FIG. 1 shows a control apparatus mounted on the hydraulic shovel 10. This control apparatus includes a drive control device DC, an operating device OP, and a signal transmission switching valve CV interposed between the drive control device DC and the operating device OP.

The drive control device DC controls the drive of the hydraulic actuators, that is to say, the traveling motors 18L and 18R, the boom cylinder 26, the arm cylinder 27, and the bucket cylinder 28. In addition, the drive control device DC controls the drive of the electric actuator, that is to say, the rotating electric motor 15. Therefore, the drive control device DC has both a hydraulic circuit and an electric circuit.

This hydraulic circuit includes a first hydraulic pump 31 and a second hydraulic pump 32 serving as hydraulic power sources. A power converter 36 is joined to the output shaft of an engine 34 and serves as a driving source of the hydraulic pumps 31 and 32. The power converter 36 functions as a generator that converts the power of the engine 34 into electric energy and outputs the electric energy to a controller 38 (to be hereinafter described). In addition, the power converter 36 functions as an electric motor that uses part of the electric energy to assist the power of the engine 34 driving the hydraulic pumps 31 and 32.

A first center bypass flow path 41 is connected to the discharge port of the first hydraulic pump 31. A second center bypass flow path 42 is connected to the discharge port of the second hydraulic pump 32. Along the first center bypass flow path 41, from the upstream side thereof, are provided a left traveling control valve 44L controlling the drive of the left traveling motor 18L, a boom cylinder control valve 46 controlling the drive of the boom cylinder 26, and a bucket cylinder control valve 48 controlling the drive of the bucket cylinder 28, in this order. On the other hand, along the second center bypass flow path 42, from the upstream side thereof, are provided a right traveling control valve 44R controlling the drive of the right traveling motor 18R, and an arm cylinder control valve 47 controlling the drive of the arm cylinder 27, in this order.

Of these control valves, the traveling control valves 44L and 44R are three-position pilot switching valve and are controlled by a traveling remote control valve (not shown). The other control valves (attachment control valves) 46, 47, and 48 are also three-position pilot switching valves.

When at their neutral positions (shown positions), the traveling control valves 44L and 44R allow all hydraulic oil to flow through the center bypass flow paths 41 and 42, respectively. When switched from the neutral positions to the shown upper positions by the operation of the traveling remote control valve, the traveling control valves 44L and 44R introduce hydraulic oil that diverges from the center bypass flow paths 41 and 42 into the traveling motors 18L and 18R, in a supply/drain direction corresponding to the direction of the operation and at a flow rate corresponding to the operation amount.

The boom cylinder control valve 46 maintains the shown neutral position when neither pilot chamber 46*a* nor 46*b* is supplied with pilot pressure. At this neutral position, the boom cylinder control valve 46 opens the first center bypass flow path 41 and allows all hydraulic oil to flow through the flow path 41. When the pilot chamber 46*a* is supplied with pilot pressure, the boom cylinder control valve 46 is switched to the shown lower position and thereby supplies the rod-side chamber of the boom cylinder 26 with hydraulic oil at a flow rate corresponding to the pilot pressure. When the pilot chamber 46*b* is supplied with pilot pressure, the boom cylinder control valve 46 is switched to the shown upper position and thereby supplies the head-side chamber of the boom cylinder 26 with hydraulic oil at a flow rate corresponding to the pilot pressure.

Similarly, the arm cylinder control valve 47 and the bucket cylinder control valve 48 maintain their shown neutral positions when neither pilot chamber (neither pilot chamber 47*a* nor 47*b* in the case of the arm cylinder control valve 47, and neither pilot chamber 48*a* nor 48*b* in the case of the bucket cylinder control valve 48) is supplied with pilot pressure. At this neutral position, all hydraulic oil is allowed to flow through the center bypass flow path (the second center bypass flow path 42 in the case of the arm cylinder control valve 47, and the first center bypass flow path 41 in the case of the bucket cylinder control valve 48). When one of the pilot chambers (the pilot chamber 47*a* in the case of the arm cylinder control valve 47, and the pilot chamber 48*a* in the case of the bucket cylinder control valve 48) is provided with pilot pressure, the arm cylinder control valve 47 and the bucket cylinder control valve 48 are switched to one of the drive positions (the shown lower position in the case of the arm cylinder control valve 47, and the shown upper position in the case of the bucket cylinder control valve 48). The rod-side chamber of the cylinder to be controlled (the arm cylinder 27 in the case of the arm cylinder control valve 47, and the bucket cylinder 28 in the case of the bucket cylinder control valve 48) is thereby supplied with hydraulic oil at a flow rate corresponding to the pilot pressure. When the other pilot chamber (the pilot chamber 47*b* in the case of the arm cylinder control valve 47, and the pilot chamber 48*b* in the case of the bucket cylinder control valve 48) is provided with pilot pressure, the arm cylinder control valve 47 and the bucket cylinder control valve 48 are switched to the other drive position (the shown upper position in the case of the arm cylinder control valve 47, and the shown lower position in the case of the bucket cylinder control valve 48). The head-side chamber of the cylinder to be controlled is thereby supplied with hydraulic oil at a flow rate corresponding to the pilot pressure.

The controller 38 has an electric power circuit and a control circuit (electric control circuit), supplies electric power output from the power converter 36 to the rotating electric motor 15, and performs drive control of the rotating electric motor 15 on the basis of electric signals input from pressure sensors 57 and 58 (to be hereinafter described). Specifically, when an electric signal is input from the pressure sensor 57, the controller 38 causes the rotating electric motor 15 to counterclockwise rotate the upper rotating body 14 at a speed corresponding to the electric signal. When an electric signal is input from the pressure sensor 58, the controller 38 causes the rotating electric motor 15 to clockwise rotate the upper rotating body 14 at a speed corresponding to the electric signal. In addition, when the rotation is braked, the controller 38 performs power regenerative control, that is to say, recaptures electric energy from the rotating electric motor 15.

Moreover, when power regenerative control is performed or when surplus power is generated due to a light hydraulic load, the controller 38 stores the recaptured power or the surplus power in the battery 35.

With the operating device OP, an operator operates the cylinders 26, 27, and 28, and the rotating electric motor 15. For this purpose, the operating device OP outputs eight kinds of pilot pressure (hydraulic signals). In the shown example, the operating device OP includes two hydraulic remote control valves 51 and 52.

The hydraulic remote control valves 51 includes an operating lever 53 serving as an operating member operatable in the anteroposterior direction and the horizontal direction (directions shown by arrows A, B, C, and D in the figure). Corresponding to the directions of the operating levers 53, four pilot reducing valves 56A, 56B, 56C, and 56D are provided as signal output valves. The primary sides of the pilot reducing valves 56A, 56B, 56C, and 56D are connected to a common pilot hydraulic power source 50 (FIG. 2A) (to be hereinafter described). If the operating lever 53 is operated in one of the four directions (forward, backward, rightward, and leftward), a pilot reducing valve corresponding to the operating direction (for example, the pilot reducing valve 56A if the operating lever 53 is operated in the direction of arrow A) outputs a pilot pressure corresponding to the operation amount.

Similarly, the hydraulic remote control valves 52 includes an operating lever 54 serving as an operating member operatable in the anteroposterior direction and the horizontal direction (directions shown by arrows E, F, G, and H in the figure). Corresponding to the directions of the operating levers 54, four pilot reducing valves 56E, 56F, 56G, and 56H are provided as signal output valves. The primary sides of the pilot reducing valves 56E, 56F, 56G, and 56H are also connected to the pilot hydraulic power source 50. If the operating lever 54 is operated in one of the four directions (forward, backward, rightward, and leftward), a pilot reducing valve corresponding to the operating direction (for example, the pilot reducing valve 56E if the operating lever 54 is operated in the direction of arrow E) outputs a pilot pressure corresponding to the operation amount.

The pilot reducing valves 56A and 56B, 56C and 56D, 56E and 56F, and 56G and 56H are paired with each other. When one of a pair of pilot reducing valves is selected by operation of the operating lever 53 (or 54), the other is always not selected. That is to say, a pair of pilot reducing valves are always alternatively selected.

Figure 2A:
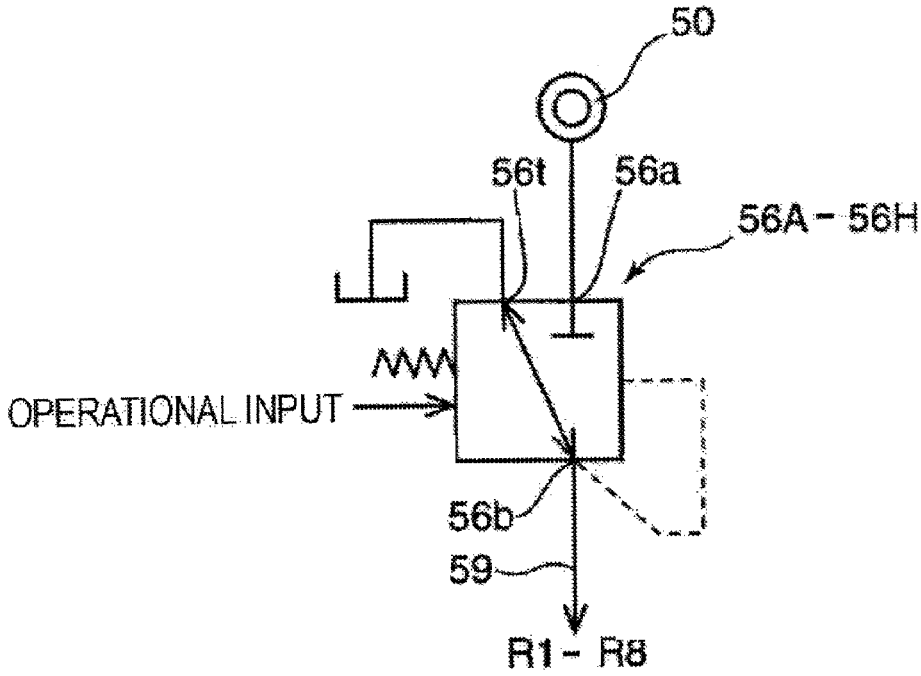
FIG. 2A is a circuit diagram showing the specific configuration of pilot reducing valves included in an operating device provided in the control apparatus.

FIG. 2A shows an example of configuration of the pilot reducing valves 56A to 56H. The shown pilot reducing valves 56A to 56H are operating proportional valves and each include an input port 56*a* connected to the pilot hydraulic power source 50 common to the pilot reducing valves 56A to 56H, an output port 56*b* connected to the signal transmission switching valve CV through a hydraulic oil flow path 59 formed by hydraulic piping (not shown), and a tank port 56*t* connected to a tank.

Of these pilot reducing valves 56A to 56H, the pilot reducing valves that are not selected by operation of the operating lever 53 or 54 communicate the hydraulic oil flow paths 59 connected to their respective output ports 56*b* to the tank. On the other hand, the pilot reducing valves selected by operation of the operating lever 53 or 54 send out hydraulic oil at a pressure proportional to the operation amount, to the hydraulic oil flow paths 59 connected to the pilot reducing valves.

As described above, a pair of pilot reducing valves are always alternatively selected. Therefore, when one of the pilot reducing valves is selected, the other pilot reducing valve always communicates the hydraulic oil flow path 59 connected to the pilot reducing valve to the tank. For example, when the pilot reducing valve 56A is selected by operation of the operating lever 53, the pilot reducing valve 56B paired with the pilot reducing valve 56A always communicates the hydraulic oil flow path 59 connected to the pilot reducing valve 56B to the tank.

The specific configuration and the number of pilot pressure outputs of this operating device OP are not limited to the above-described ones and can be set according to the apparatus specification. For example, in order to output eight kinds of pilot pressures as in the shown apparatus, four sets of two-direction hydraulic remote control valves may be provided. Alternatively, the apparatus may be provided only with the shown hydraulic remote control valve 51 so as to have four pilot pressure outputs.

The signal transmission switching valve CV is for switching between a plurality of combinations of the pilot pressures output from the pilot reducing valves 56A to 56H of the operating device OP, and the control valves 46, 47, and 48 and the rotating electric motor 15 operated by the pilot pressures. In the shown example, the signal transmission switching valve CV is a four-position manual switching valve.

Specifically, the signal transmission switching valve CV includes eight input ports R1, R2, R3, R4, R5, R6, R7, and R8, eight output ports C1, C2, C3, C4, CS, C6, C7, and C8, and an operating lever 60 operatable from outside. By operation of the operating lever 60, switching is performed between the shown four positions a, b, c, and d. At these positions, the input ports are communicated one-to-one to the output ports as shown in the following Table 1.

TABLE 1

| | Position to be switched | | | |
|---|---|---|---|---|
| | a | b | c | d |
| R1 | C6 | C1 | C5 | C1 |
| R2 | C5 | C2 | C6 | C2 |
| R3 | C7 | C3 | C8 | C3 |
| R4 | C8 | C4 | C7 | C4 |
| R5 | C1 | C5 | C1 | C7 |
| R6 | C2 | C6 | C2 | C8 |
| R7 | C4 | C7 | C4 | C6 |
| R8 | C3 | C8 | C3 | C5 |

The input ports R1, R2, R3, R4, RS, R6, R7, and R8 are respectively connected to output ports (secondary ports) 56*b* of the pilot reducing valves 56A, 56B, 56C, 56D, 56E, 56F, 56G, and 56H of the operating device OP via the hydraulic oil flow paths 59. In addition, the output ports C1, C2, C3, C4, C5, and C6 are respectively connected to the pilot chamber 46*a* of the boom cylinder control valve 46, the pilot chamber 46*b* of the valve 46, the pilot chamber 48*a* of the bucket cylinder control valve 48, the pilot chamber 48*b* of the valve 48, the pilot chamber 47*a* of the arm cylinder control valve 47, and the pilot chamber 47*b* of the valve 47, via hydraulic piping.

On the other hand, the output port C7 is connected to the pressure sensor 57 serving as a first signal converting means via a hydraulic oil flow path 67 formed by hydraulic piping. Similarly, the output port C8 is connected to the pressure sensor 58 serving as a second signal converting means via a hydraulic oil flow path 68 formed by hydraulic piping.

These pressure sensors 57 and 58 are connected to the controller 38 via electric lines, generate electric signals corresponding to the pilot pressures transmitted to the output ports C7 and C8 (that is to say, the pressures of the hydraulic oil supplied through the hydraulic oil flow paths 67 and 68), and output the signals to the controller 38.

Figure 2B:
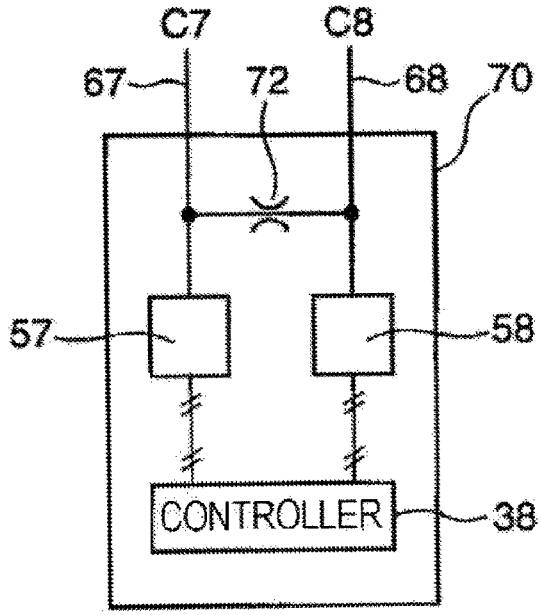
FIG. 2B shows the circuit configuration of pressure sensors provided in the control apparatus and the vicinity thereof.

In addition, as shown in FIG. 2B, the hydraulic oil flow paths 67 and 68 that are connected to the pressure sensors 57 and 58 are connected with each other via a throttle 72. The size of the throttle 72 is set so as to be able to transmit air and the like in the hydraulic oil without affecting the transmission of the pilot pressure to the pressure sensor 57 or 58 through the hydraulic oil flow path 67 or 68.

In addition, the pressure sensors 57 and 58 are housed, together with the controller 38 connected thereto and electric lines for the connection, in a common electromagnetic shield container 70. Specifically, the pressure sensors 57 and 58 and the controller 38 may be housed in a single electromagnetic shield container 70. Alternatively, it is possible to attach an electromagnetic shield container housing the controller 38 to the outer wall of another electromagnetic shield container housing the pressure sensors 57 and 58 so that both containers are unified.

The above-described apparatus makes it possible to operate both the hydraulic actuators (cylinders 26, 27, and 28) and the electric actuator (rotating electric motor 15) with the operating device OP employing only the inexpensive hydraulic remote control valves 51 and 52. In addition, by switching operation of the signal transmission switching valve CV, the combination of the operating directions of the hydraulic control valves 51 and 52 and the corresponding actuators to be operated can be easily changed.

For example, in the case where the signal transmission switching valve CV is switched to position b, when the operating lever 53 of the hydraulic remote control valve 51 is operated in the direction of arrow A in FIG. 1, the pilot reducing valve 56A corresponding to the operating direction sends out hydraulic oil at a pressure (pilot pressure) corresponding to the operation amount of the operating lever 53 to the input port R1 of the signal transmission switching valve CV through the hydraulic oil flow path 59. Consequently, hydraulic oil at this pilot pressure flows from the output port Cl of the valve CV into the pilot chamber 46*a* of the boom cylinder control valve 46. Receiving the input of pilot pressure, the boom cylinder control valve 46 is switched to the shown lower position, and introduces the hydraulic oil discharged from the hydraulic pump 31 into the rod-side chamber of the boom cylinder 26 at a flow rate corresponding to the pilot pressure, thereby contracting the cylinder 26.

When the operating lever 54 of the hydraulic remote control valve 52 is operated in the direction of arrow G in FIG. 1, the pilot reducing valve 56G corresponding to the operating direction inputs a pilot pressure corresponding to the operation amount of the operating lever 54 into the input port R7 of the signal transmission switching valve CV. This pilot pressure is transmitted to the output port C7 of the valve CV. The output port C7 is connected to the pressure sensor 57. Therefore, the pressure sensor 57 converts the pilot pressure into a corresponding electric signal and inputs the electric signal into the controller 38. On the basis of the electric signal, the controller 38 controls the driving direction and the driving speed of the rotating electric motor 15.

Specifically, the hydraulic oil sent out from the pilot reducing valve 56G flows into the pressure sensor 57 through the hydraulic oil flow path 59, the signal transmission switching valve CV, and the hydraulic oil flow path 67. If the hydraulic oil flow path 67 dead-ends at the pressure sensor 57, air and the like in the hydraulic oil stay before the pressure sensor 57 (air accumulation) and can deteriorate the signal conversion function of the sensor 57. In this apparatus, the hydraulic oil flow path 67 is connected to another hydraulic oil flow path 68 via the throttle 72 in an appropriate size. Therefore, air accumulation is effectively prevented without hindering transmission of pilot pressure to the pressure sensor 57 through the hydraulic oil flow path 67.

That is to say, when the pilot reducing valve 56G is selected by operation of the operating lever 54, the pilot reducing valve 56H paired with the pilot reducing valve 56G is not selected. Therefore, the pilot reducing valve 56H communicates the hydraulic oil flow path 59 connected to the pilot reducing valve 56H, and the hydraulic oil flow path 68 to which the hydraulic oil flow path 59 is connected via the signal transmission switching valve CV, to the tank. Therefore, air and the like in the hydraulic oil supplied to the pressure sensor 57 through the hydraulic oil flow path 67 is effectively allowed to escape to the tank side through the throttle 72, the hydraulic oil flow paths 68 and 59, and the pilot reducing valve 56H.

That is to say, the pilot reducing valve 56H that is not selected communicates the hydraulic oil flow path 59 connected to the pilot reducing valve 56H to the tank in order to reduce its output pilot pressure. By effectively using this operation, this apparatus can remove air and the like from the hydraulic oil sent out from the pilot reducing valve 56G paired with the pilot reducing valve 56H.

Similarly, when the operating lever 54 is operated in the direction of arrow H in FIG. 1 and the pilot reducing valve 56H is selected, the pilot reducing valve 56H sends hydraulic oil at a predetermined pressure to the pressure sensor 58 through the hydraulic oil flow path 59 and the hydraulic oil flow path 68. In this case, air and the like in the hydraulic oil is allowed to escape to the tank side through the throttle 72, the hydraulic oil flow path 67, and the hydraulic oil flow path 59 connected to the pilot reducing valve 56G paired with the pilot reducing valve 56H, by the pilot reducing valve 56G.

That is to say, when the signal transmission switching valve CV is switched to position b, the pilot reducing valves 56G and 56H that are paired with each other and that are alternatively selected are connected to the pressure sensors 57 and 58, respectively. Therefore, the pilot reducing valve 56G serves as "a first signal output valve" connected to the pressure sensor 57, that is to say, the first signal converting means. The pilot reducing valve 56H serves as "a second signal output valve" connected to the pressure sensor 58, that is to say, the second signal converting means.

When the signal transmission switching valve CV is switched from position b to position a and the operating lever 54 is operated in the direction of arrow G in FIG. 1, the pilot pressure output from the pilot reducing valve 56G is input into the pilot chamber 48*b* of the bucket cylinder control valve 48 via the input port R7 and the output port C4. The pilot pressure contributes to the expansion operation of the bucket cylinder 28.

On the other hand, the signal transmission switching valve CV switched to position a communicates the hydraulic oil flow paths 67 and 68 that are connected to the pressure sensors 57 and 58 to the input ports R3 and R4, respectively. The hydraulic oil flow paths 67 and 68 are thereby connected to the pilot reducing valves 56C and 56D of the operating device OP that are connected to the input ports R3 and R4. Therefore, in this case, the pilot reducing valve 56C serves as "a first signal output valve" according to the present invention, and the pilot reducing valve 56D serves as "a second signal output valve" according to the present invention.

That is to say, since the output ports C7 and C8 of the signal transmission switching valve CV are connected to the pressure sensors 57 and 58, it is possible to select reducing valves to be involved in the control of the rotating electric motor 15, which is an electric actuator, that is to say, to select "a first signal output valve" and "a second signal output valve" according to the present invention from the pilot reducing valves 56A to 56H by switching operation of the switching valve CV. With this switching operation, the first signal output valve and the second signal output valve connected to the pressure sensors 57 and 58 are switched.

The pressure sensors 57 and 58 are housed in the common electromagnetic shield container 70. Therefore, this apparatus can effectively prevent the signal conversion function of the pressure sensors 57 and 58 from being hindered by external noise, in spite of its simple structure. If, as shown in FIG. 2B, in addition to the pressure sensors 57 and 58, the controller 38 to which the pressure sensors 57 and 58 are connected, and electric lines for the connection are housed in the common electromagnetic shield container 70, the electric lines can be effectively prevented from being affected by noise, and thereby the accuracy of electric control can be further improved.

Electric actuators controlled by the present invention are not limited to the rotating electric motor 15. A plurality of electric actuators including the rotating electric motor 15 may be set as controlled objects. In the shown apparatus, the power converter 36 functions as both a generator and an electric motor, and the power converter 36 drives the hydraulic pumps 31 and 32. However, it is possible to separate the function as a generator and the function as an electric motor, to join dedicated electric motors to the hydraulic pumps 31 and 32, and to set the controlled objects (electric actuators) of the apparatus according to the present invention to these electric motors.

If, as shown, the apparatus has a rotating electric motor 15 as an electric actuator, a large amount of regenerative energy (electric energy) can be recaptured when its rotation is braked, and the working efficiency of the entire working machine can be dramatically improved.

The present invention can also be effectively applied to an apparatus that does not have the signal transmission switching valve CV, that is to say, an apparatus such that the operating device OP and the drive control device DC are directly connected. Also in this case, both hydraulic actuators and electric actuators can be controlled with an inexpensive hydraulic operating device.

Signal converting means according to the present invention have to include at least a first signal converting means and a second signal converting means and may include any additional signal converting means.

Although the invention has been described with reference to the preferred embodiments in the attached figures, it is noted that equivalents may be employed and substitutions made herein without departing from the scope of the invention as recited in the claims.

What is claimed is:

1. A working machine comprising:

actuators including a hydraulic actuator and an electric actuator; and a control apparatus that controls operation of the actuators, wherein the control apparatus comprises:

an operating device that outputs hydraulic signals according to operation of an operating member;

a hydraulic control means that receives one of the hydraulic signals output from the operating device and controls operation of the hydraulic actuator;

a plurality of signal converting means that convert the other hydraulic signals output from the operating device into electric signals corresponding to their respective hydraulic pressures; and an electric control means that receives the electric signals from the signal converting means and controls operation of the electric actuator, and wherein the plurality of signal converting means include a first signal converting means and a second signal converting means, the operating device includes a first signal output valve and a second signal output valve that are respectively connected to the first signal converting means and the second signal converting means via hydraulic fluid flow paths and that are alternatively selected by operation of the operating member, one of the first signal output valve and the second signal output valve selected by operation of the operating member sends out hydraulic fluid at a fluid pressure corresponding to the operation amount of the operating member to the signal converting means to which the signal output valve is connected, and the other signal output valve communicates the hydraulic fluid flow path connected to the signal output valve to a tank, and the hydraulic fluid flow paths are connected to each other via a throttle, wherein the control apparatus further comprises a signal transmission switching valve provided between the signal output valves and the hydraulic control means and electric control means, wherein the signal transmission switching valve includes a plurality of input portions that are connected to the signal output valves and into which hydraulic fluid flows and a plurality of output portions from which the hydraulic fluid flows out, one of the output portions is connected to the hydraulic control means, another of the output portions is connected to the signal converting means including the first signal converting means and the second signal converting means, wherein the signal transmission switching valve is adapted to switch between positions corresponding to a plurality of combinations of the input portions and the output portions communicated to the input portions, whereby a signal from either of the first and second signal output valves may be converted into electric signals by the signal converting means depending on the position of the signal transmission switching valve.

2. The working machine according to claim 1, wherein the first signal converting means and the second signal converting means are housed in a common electromagnetic shield container.

3. The working machine according to claim 2, wherein the common electromagnetic shield container further houses the electric control means to which the first signal converting means and the second signal converting means are connected and electric lines for the connection.

4. The working machine according to claim 1, wherein the electric actuator includes a rotating electric motor that rotates a rotating body of the working machine.

* * * * *